United States Patent [19]

Dunn et al.

[11] Patent Number: 4,544,200

[45] Date of Patent: Oct. 1, 1985

[54] WHEELCHAIR WITH ROCKING SEAT AND RECLINING BACK FEATURE

[75] Inventors: Philip Dunn, 9221 N. Odell, Morton Grove, Ill. 60053; David A. King, Oconomowoc, Wis.

[73] Assignee: Philip Dunn, Morton Grove, Ill.

[21] Appl. No.: 500,416

[22] Filed: Jun. 2, 1983

[51] Int. Cl.[4] ..... A47C 3/02

[52] U.S. Cl. ..... 297/265; 297/DIG. 4; 297/270; 297/342

[58] Field of Search ..... 297/265, 270, 261, 272, 297/341, 342, 340, DIG. 4, 133, 440; 280/DIG. 10

[56] References Cited

U.S. PATENT DOCUMENTS

| | | | |
|---|---|---|---|
| 1,822,427 | 9/1931 | Wenn et al. | 297/444 X |
| 3,371,959 | 3/1968 | Gordin | 297/270 X |
| 3,415,531 | 12/1968 | Kiel | 297/261 X |
| 3,455,600 | 7/1969 | Secor et al. | 297/270 X |
| 3,637,255 | 1/1972 | Re | 297/270 X |
| 3,712,671 | 1/1973 | Dalton et al. | 297/270 X |
| 3,917,312 | 11/1975 | Rodaway | 297/DIG. 4 X |
| 3,976,152 | 8/1976 | Bell | 280/DIG. 10 X |
| 4,118,046 | 10/1978 | Vaughan | 297/270 X |
| 4,143,911 | 3/1979 | Sakakibara et al. | 297/341 |
| 4,167,288 | 9/1979 | Kiang | 297/342 X |

FOREIGN PATENT DOCUMENTS

| | | | |
|---|---|---|---|
| 1091373 | 10/1954 | France | 297/342 |

*Primary Examiner*—Philip C. Kannan

*Attorney, Agent, or Firm*—Silverman, Cass & Singer, Ltd.

[57] ABSTRACT

A wheelchair seat and back construction adapted to be removably mounted upon a conventional wheelchair frame. A chair base with seat and back member secured thereto is mounted to a chair support by springs positioned between the base and support with the support secured to the wheelchair frame such that the wheelchair user can rock in the chair by reason of the spring mounting between the chair support and chair base. Front and rear lock levers are provided to selectively secure the chair base with seat and back member attached relative to the wheelchair frame to maintain the seat and back in rigid, unrocking condition. The seat and back members are hingedly connected to each other with the seat member being slidably movable upon tracks mounted to the chair base to permit the back member to move into a reclining position for the user upon movement of the seat member. Movement of the seat member upon said tracks is controlled by a reclining release lever which may selectively be positioned for access from the front or rear of the wheelchair so as to prevent the wheelchair user from moving the back member into reclining position, if desired.

44 Claims, 8 Drawing Figures

FIG. 1
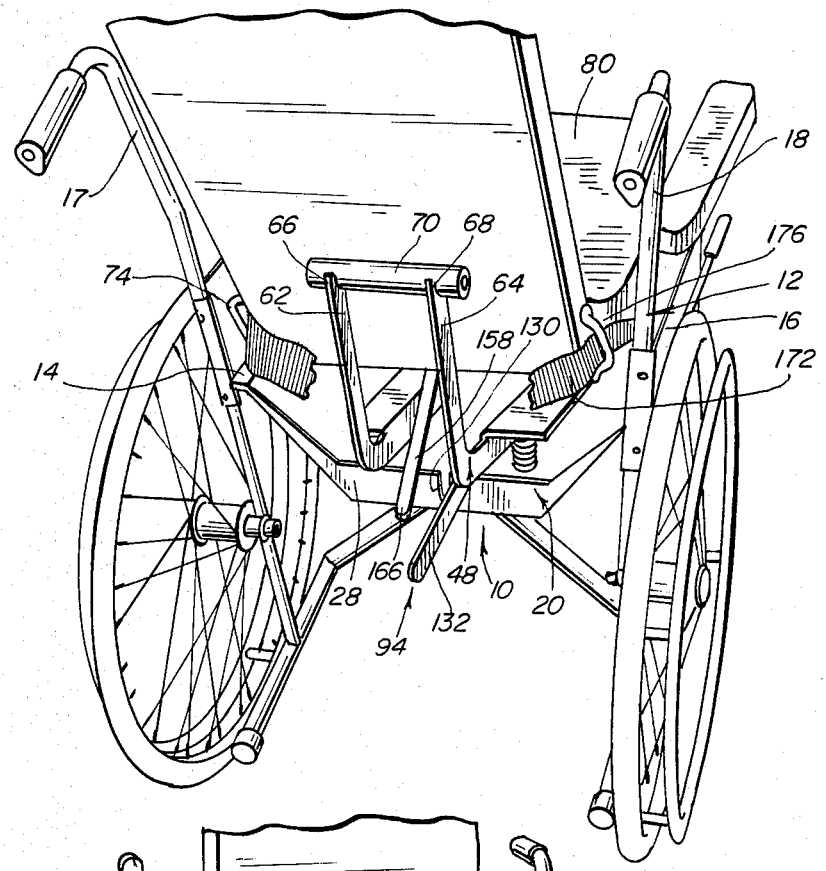
FIG. 2
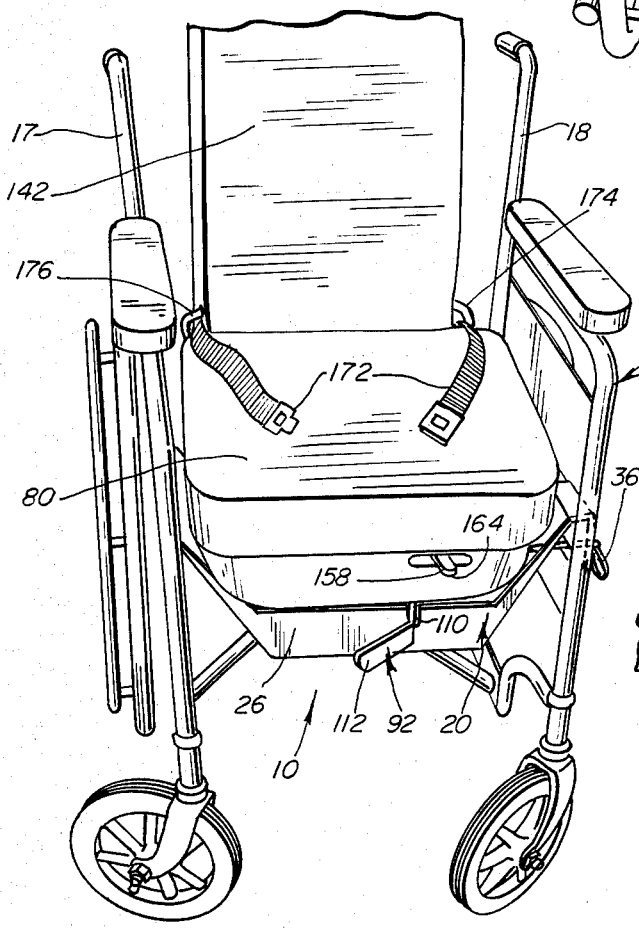
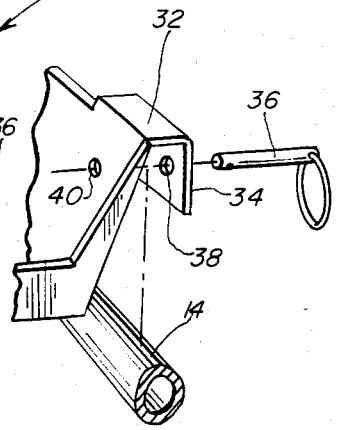
FIG. 3

FIG. 4
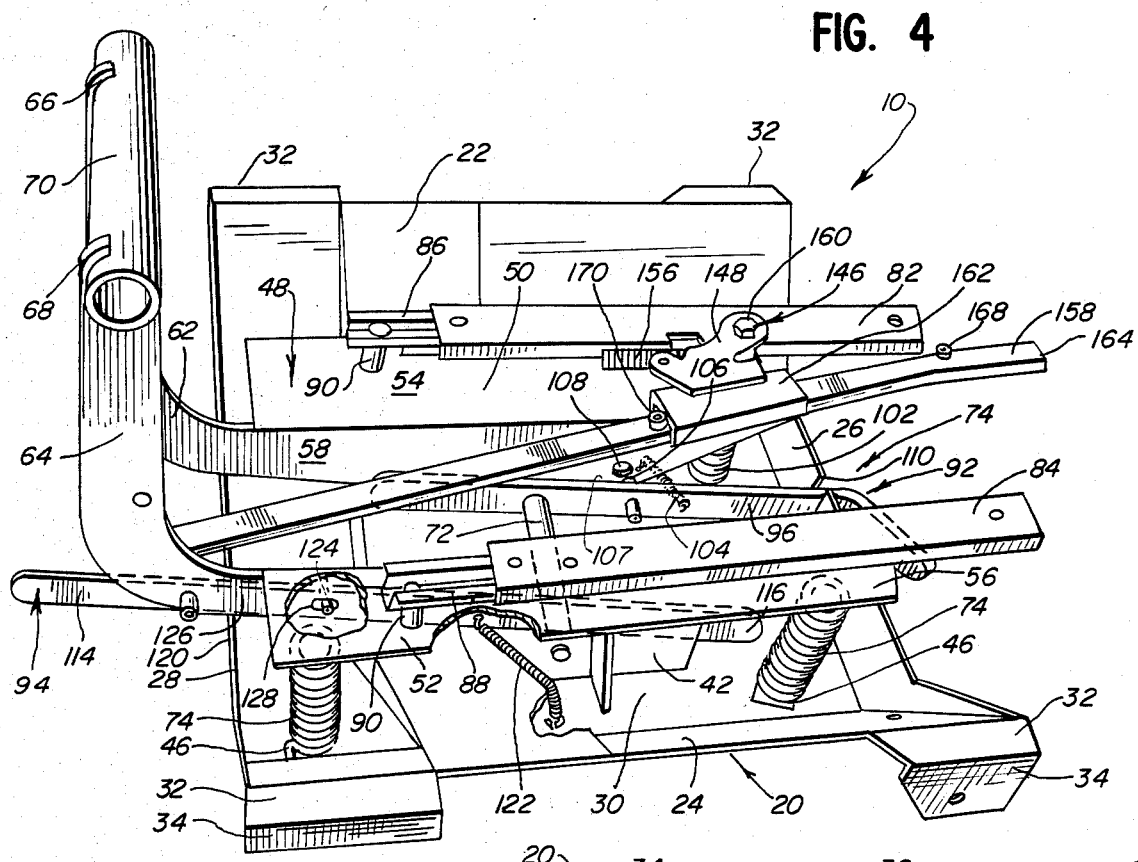
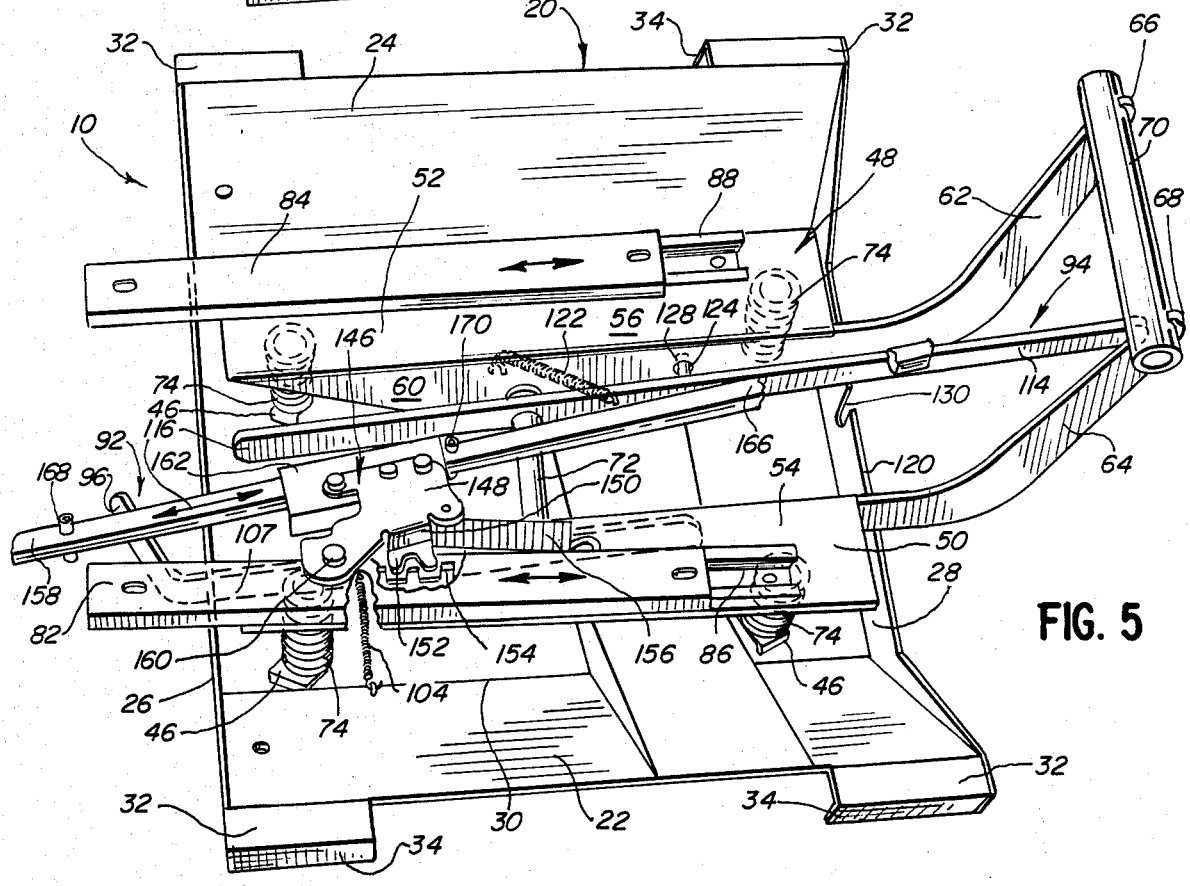
FIG. 5

WHEELCHAIR WITH ROCKING SEAT AND RECLINING BACK FEATURE

BACKGROUND OF THE INVENTION

1. Field of the Invention

This invention relates generally to wheelchairs for disabled persons, and more particularly, to such a wheelchair in which the seat is selectively rockable and the back is selectively movable to a reclining position.

2. Description of the Prior Art

Wheelchairs for handicapped persons commonly are constructed of a rigid, wheeled frame with stationary positioned seat and back members. The users of such chairs are restricted to single position, stationary use of the seat and back portions relative to the frame of such wheelchairs.

It is known that rocking and/or bouncing motion can render therapeutic and/or relaxing benefits for handicapped persons, such as those having muscle, spinal, and/or other disorders. Persons having such disorders commonly are confined to a wheelchair for their transportation because they are not ambulatory. When it is desired to provide such persons with the benefits of rocking and/or bouncing motion, it has been necessary to physically move such persons from conventional wheelchairs to other seating devices which enable the handicapped person to rock and/or bounce in the seating device, as desired.

It also is known to provide conventional wheelchairs with a reclining back feature in which the back member of the chair is pivotal about a hinged connection to move the user's back into a semi-reclining or full reclining position on the chair for rest or other beneficial relaxing position of the user.

Further, it is known to provide a wheelchair construction in which the seat and/or back members are removable from the chair frame which is foldable in order to render such wheelchairs relatively portable.

Prior art wheelchairs include constructions in which the seat member is resiliently mounted upon the chair frame in an effort to maintain the seat in a relatively constant orientation while the wheelchair is moving on an inclined surface so as to have the user of the chair feel secure while the chair is so moving. Constructions also are known in which the wheelchair frame includes shock absorbers and springs to facilitate a relatively smooth ride for the user. Such prior art wheelchairs do not include or contemplate structure to enable the chairs to be used by a person seated thereon as a rocking chair or for bouncing motion.

With respect to the prior art wheelchairs which enable movement of the back member into a reclining position, such chairs merely provide for pivoting of the back member relative to a stationary positioned seat member. Movement of the wheelchair back member alone into a reclining position with a person seated in the chair may cause the center of gravity of the person to move to a location which results in imbalance and instability of the chair with tipping of the chair possible. This condition is avoidable if the seat and back members are connected along a common edge so that the seat is moved simultaneously with reclining of the back member to maintain the center of gravity of the user at a proper location on the chair so as to prevent such imbalance with resultant tipping of the chair to the user's injury.

The following U.S. Pat. Nos. are illustrative of the above prior art wheelchairs: 3,917,312 3,976,152 4,170,360 4,209,037

The present invention provides a wheelchair in which the seat and back members are removable from the wheelchair as a unit to permit portability thereof. The seat member is rockable relative to the chair frame upon release of safety locking levers provided for selective access from the front and rear of the chair. The chair back is reclinable upon movement of the seat member which is connected to the back so that reclining of the back moves the center of gravity of the user relative to the chair frame to provide for stability upon reclining.

SUMMARY OF THE INVENTION

A wheelchair seat and back construction including a seat and back member hingedly connected to each other with the seat secured to a chair base mounted upon a chair support with resilient spring members secured between the base and support. Respective lock levers accessible from the front and rear of the chair are positioned between the base and support to selectively maintain the seat portion in rigid, unrocking condition relative to the chair support. Securement of said lock levers in their locking condition prevents rocking movement of the seat relative to the support, as desired. The seat member is movable along its horizontal place relative to the chair support. Movement of the seat member causes the attached back member to move into a reclining position in which the center of gravity of the user is maintained relative to the wheelchair frame to prevent instability of the chair. The chair support with base mounted thereon is removable from the wheelchair frame to facilitate portability thereof.

BRIEF DESCRIPTION OF THE DRAWINGS

FIG. 1 is a fragmentary perspective view of the rear of a wheelchair having the rocking seat and back construction of the invention positioned thereon.

FIG. 2 is a fragmentary perspective view of the front of said wheelchair showing the rocking seat and back construction of the invention positioned thereon.

FIG. 3 is a fragmentary perspective view showing one side flange of the chair support of the invention and the manner in which it is secured to a wheelchair frame.

FIG. 4 is a partially fragmentary, perspective view of the chair support, chair base and associated elements of the invention.

FIG. 5 is a partially fragmentary, perspective view similar to that of FIG. 4 showing the chair support, chair base and associated elements as viewed from the side opposite that shown in FIG. 4.

DESCRIPTION OF THE PREFERRED EMBODIMENT

Figure 6:
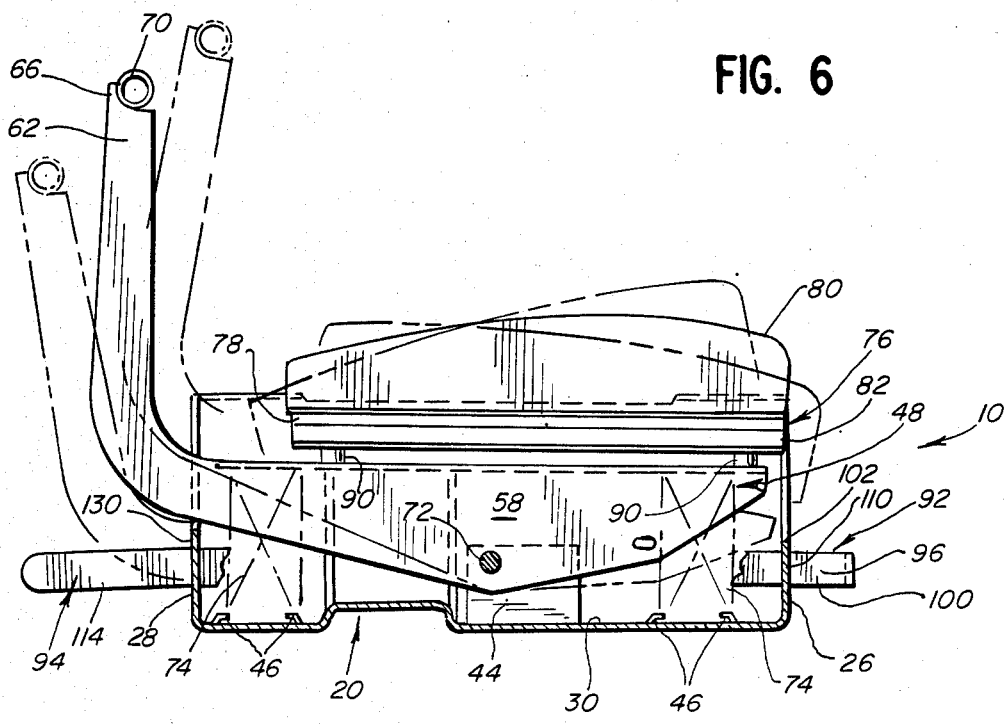
FIG. 6 is a sectional view showing the chair support, chair base, seat cushion and locking levers of the invention illustrated in release condition to permit rocking movement of the chair base and seat cushion.

Referring to FIGS. 1 and 2, the wheelchair seat and back construction 10 of the invention is illustrated positioned upon a wheelchair frame 12. The frame 12 is of standard construction with wheels and brace bars including parallel side braces 14, 16 extending horizontally between the vertical front frame members and rear frame members 17, 18 of the chair. A conventional wheelchair including frame 12 commonly also includes a seat web or pad retained between side braces 14, 16 and a back web or pad positioned between the rear frame members 17, 18. In the wheelchair frame 12 illustrated in the drawings, the conventional seat and back web members have been removed to permit positioning of the seat and back construction 10 of the invention upon frame 12 as described below. In all other respects, frame 12 is illustrated in unmodified condition. It is to be understood that the wheelchair frame 12 per se forms no part of the present invention and the invention herein is useable with any prior known frame of standard construction.

The seat and back construction 10 includes a generally dish-shaped chair support member 20 having respective parallel side walls 22, 24 and respective parallel front and rear walls 26, 28, with base surface 30 disposed between said walls. Each side wall 22, 24 has formed thereon respective front and rear flange extensions 32 which are return bent to form generally U-shaped mounting brackets 34. Chair support 20 is positionable upon wheelchair frame 12 in the usual seat location thereof by locating respective mounting brackets 34 over side braces 14, 16 so that the brackets seat firmly over said side braces. As illustrated in FIG. 3, upon positioning of respective mounting brackets 34 over side braces 14, 16, lock pins 36 are inserted through registered apertures 38, 40 in brackets 34 disposed below side braces 14, 16 to firmly retain the brackets and chair support 20 upon wheelchair frame 12. In the same manner, support 20 is removable from wheelchair frame 12 by removing pins 36.

Referring to FIGS. 4–7, chair support 20 includes respective upstanding mounting flanges 42, 44 formed upon base surface 30 proximate the central area thereof. Base surface 30 also is provided with upstanding coil spring mounting flanges 46 positioned proximate the respective corners of said base surface 30 at the location where side walls 22, 24 and front and rear walls 26, 28 are joined.

Chair base 48 is disposed above chair support 20 and includes respective L-shaped flanges 50, 52 each having a generally horizontally disposed leg 54, 56 and a generally vertically disposed leg 58, 60. Each vertical leg 58, 60 has a respective extension part 62, 64 disposed above the horizontal legs 54, 56 of flanges 50, 52. Extension parts 62, 64 are joined at their terminal ends 66, 68 by a generally cylindrical brace member 70. By reason of the joinder of legs 58, 60 with brace member 70, L-shaped flanges 50, 52 forming chair base 48 function as a single unit in their mcvement as described below.

Chair base 48 is mounted upon chair support 20 by positioning of vertically disposed legs 58, 60 of L-shaped flanges 50, 52 proximate to upstanding mounting flanges 42, 44 on base surface 30. Pivot pin 72 passes through respective registered apertures formed in upstanding mounting flanges 42, 44 and vertically disposed legs 58, 60 of the respective chair support and chair base members. Four coil springs 74 are located between chair support 20 and chair base 48 by mounting respective ends of said springs between spring mounting flanges 46 on base surface 30 and the undersides of horizontally disposed legs 54, 56 of L-shaped flanges 50, 52. When so mounted, chair base 48 is pivotal about pivot pin 72 with respect to chair support 20. Coil springs 74 provide for rocking movement of support 20 as it pivots about pin 72.

The horizontally disposed legs 54, 56 of each L-shaped flange 50, 52 are adapted for mounting therebetween a seat platform or member 76 which includes a flat surface 78 and a cushion part 80 for the comfort of the wheelchair user. Seat platform 76 is secured by suitable screws or bolts (not shown) to respective seat mounting tracks 82, 84 which ride upon corresponding track guides 86, 88 secured to respective horizontal legs 54, 56 by mounting members 90. As seen in FIG. 6, seat platform 76 mounted upon tracks 82, 84 is movable in rocking fashion by the user of the chair seated thereon when the user shifts his or her weight on the seat. Shifting of the user's weight causes the chair base to rock about pivot pin 72 against the springs 74 with respect to chair support 20.

Figure 7:
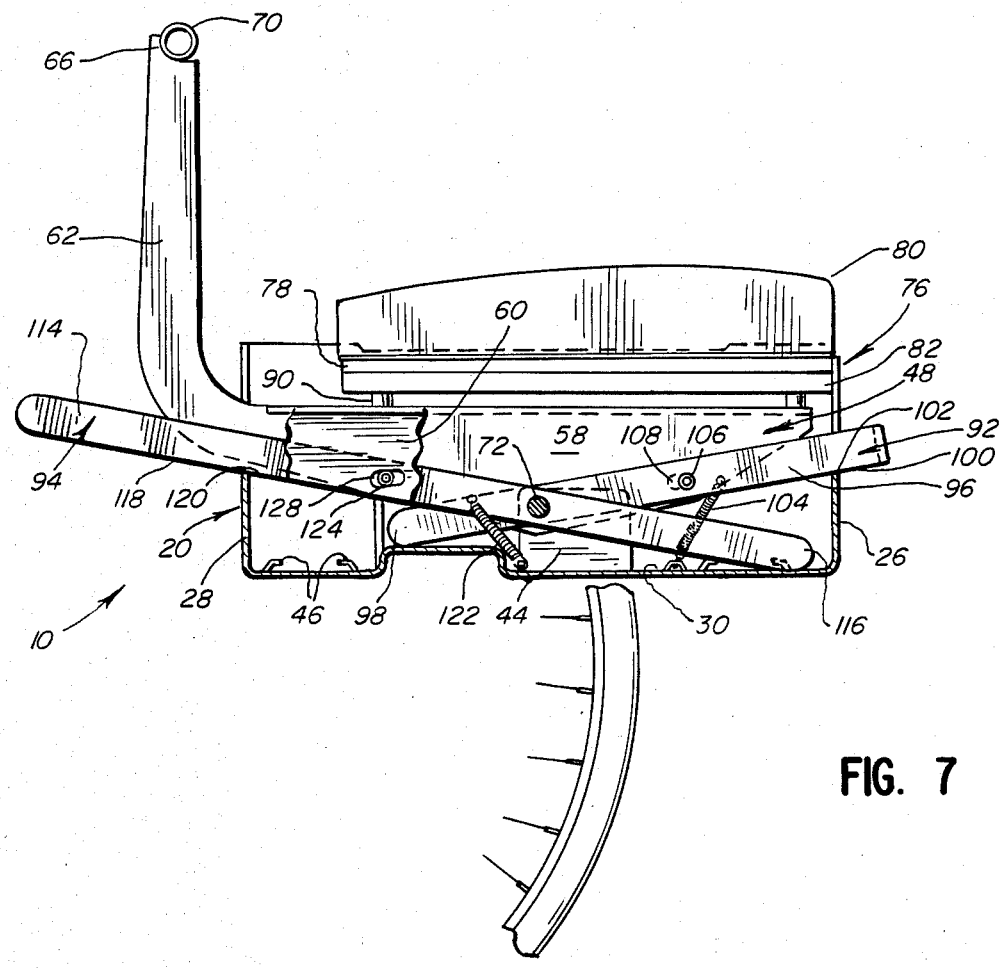
FIG. 7 is a sectional, partially fragmentary view similar to that of FIG. 6 showing the locking levers in locked condition to prevent rocking movement of the chair base and seat cushion.

During certain periods of use of the wheelchair upon which the seat and back construction 10 of the invention is mounted, it will be desired that the seat member 76 be prevented from rocking as illustrated in FIG. 7. For this purpose, front and rear locking levers 92, 94 for the user's convenience and safety are provided as a part of the seat and back construction 10.

Front locking lever 92 is formed as a generally elongate, flat bar 96. Bar 96 is provided with an aperture proximate the mid-length thereof such that the bar is positionable upon pivot pin 72 between mounting flanges 42, 44 and vertically disposed legs 58, 60 of chair support 20 and chair base 48. Bar 96 thereby is pivotal about pivot pin 72 between a first, locking position illustrated in FIG. 7 and a second, unlocking position illustrated in FIG. 6. Bar 96 is movable into its locking position shown in FIG. 7 by pivoting the same about pivot pin 72 such that terminal end 98 of the bar is disposed to abut base surface 30 of chair support 20. When so disposed, the undersurface 100 of bar 96 is engaged against the terminal edge 102 of front wall 26 of chair support 20. Locking lever spring 104 secured between bar 96 and base surface 30 acts upon bar 96 to pull the same against vertically disposed leg 58 of L-shaped flange 50. Roll pin 106 projecting from the side surface 107 of bar 96 is matingly engageable in aperture 108 formed in vertically disposed leg 58 when bar 96 is drawn against leg 58 by locking lever spring 104. When pin 106 is disposed within aperture 108, rocking movement of chair base 48 is prevented by reason of engagement of end 98 against surface 30 and undersurface 100 against terminal edge 102.

Locking lever 92 is disengageable from its locking position illustrated in FIG. 7 by movement of the lever to withdraw roll pin 106 from aperture 108 and sliding of the undersurface 100 along terminal edge 102 to seat bar 96 in slot 110 formed in front wall 26. In this position, illustrated in FIG. 6, bar 96 is pivoted about pivot pin 72 to separate terminal end 98 from base surface 30. Because of the separation of roll pin 106 from aperture 108, chair base 48 thereby is permitted to pivot about pivot pin 72 with respect to chair support 20.

As illustrated in FIG. 2, the operating handle part 112 of locking lever 92 is disposed adjacent the front of the wheel chair and is accessible to the person who is seated in the chair. In instances where it is desired to prevent the person seated in the chiar from locking or unlocking the same so as to permit use as a rocking chair, a second, rear locking lever 94, which is not accessible to the user of the chair, is provided. As will become clear from the description below, both front and rear locking levers 92, 94 must be moved to their respective unlocking positions illustrated in FIG. 6 in order to permit the wheelchair seat and back construction 10 to be operable as a rocking chair. This safety feature is included for the protection of the wheelchair user.

Rear locking lever 94 is formed similar to front locking lever 92 as a generally elongate flat bar 114. Bar 114 is provided with an aperture proximate the mid-length thereof to permit the bar to be positioned with pivot pin 72 passing therethrough. Bar 114 is positioned upon pivot pin 72 at a location between mounting flanges 42, 44 and vertically disposed legs 58, 60 of chair support 20 and chair base 48. Bar 114 thereby is pivotal about pivot pin 72 between a first, locking position illustrated in FIG. 7 and a second, unlocking position, illustrated in FIG. 6. Bar 114 is movable into its locking position shown in FIG. 7 by pivoting the same about pivot pin 72 such that terminal end 116 of the bar is disposed to abut base surface 30 of chair support 20. When so disposed, the undersurface 118 of bar 114 is engaged against the terminal edge 120 of rear wall 28 of chair support 20. Locking lever spring 122 secured between bar 114 and base surface 30 acts upon bar 114 to pull the same against vertically disposed leg 60 of L-shaped flange 52. Roll pin 124 projecting from the side surface 126 of bar 114 is matingly engageable in aperture 128 formed in vertically disposed leg 60 when bar 114 is drawn against leg 60 by locking lever spring 122. When pin 124 is disposed within aperture 128, rocking movement of chair base 48 is prevented by reason of engagement of end 116 against surface 30 and undersurface 118 against terminal edge 120.

Locking lever 94 is disengageable from its locking position illustrated in FIG. 7 by movement of the lever to withdraw roll pin 124 from aperture 128 and sliding of the undersurface 118 along terminal edge 120 to seat bar 114 in slot 130 formed in rear wall 28. In this position, illustrated in FIG. 6, bar 114 is pivoted about pivot pin 72 to separate terminal end 116 from base surface 30. Because of the separation of roll pin 124 from aperture 128, chair base 48 thereby is permitted to pivot about pivot pin 72 with respect to chair support 20.

As illustrated in FIG. 1 the operating handle part 132 of locking lever 94 is disposed adjacent the rear of the wheelchair at a location which is not accessible to the person who is seated in the chair. In order for the chair base 48 with seat member 76 attached to be movable or rockable with respect to chair support 20, both locking levers 92, 94 must be positioned in their unlocking condition shown in FIG. 6. If either locking lever 92, 94 is moved to its locking position shown in FIG. 7, chair base 48 cannot be moved relative to chair support 20. Therefore, in instances where it is desired to prevent the person seated in the chair from using the same as a rocking chair, movement of the rear locking lever 94 into its locking position will prevent use of the chair for rocking movement irrespective of the position or movement of the front locking lever 92. This dual locking lever feature of the invention provides a safety measure for protection of the user of the chair.

Figure 8:
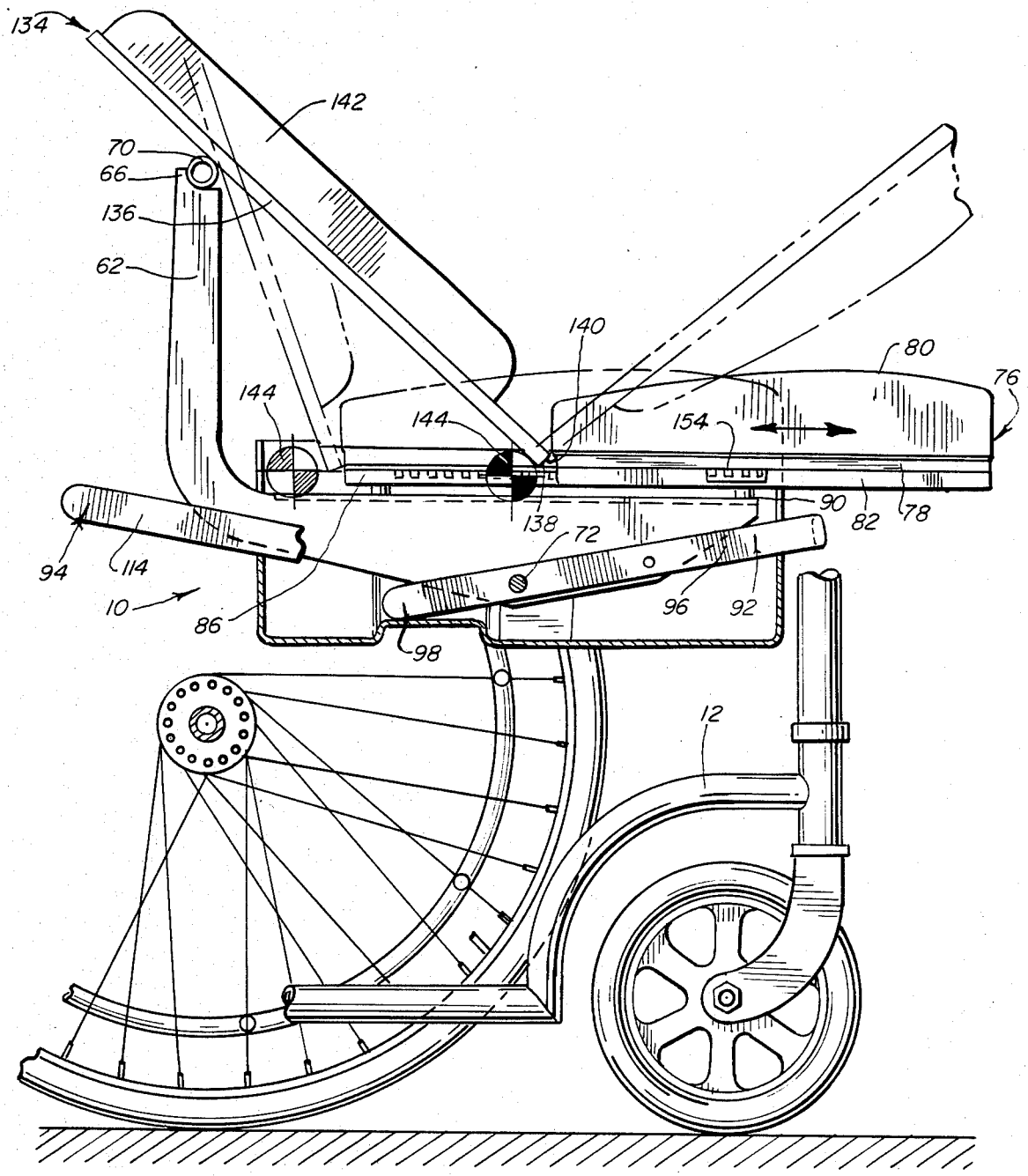
FIG. 8 is a fragmentary sectional view similar to that of FIG. 7 showing movement of the seat and back members into reclining position of the back.

As seen most clearly in FIGS. 4, 5 and 8, the wheelchair seat and back construction 10 of the invention also includes structure to permit the user thereof to be moved into a reclining position on the chair. Back rest member 134 includes flat surface 136 which is hingedly connected along one edge 138 thereof to the rear edge 140 of flat surface 78 of seat member 76. Cushion part 142 is provided upon flat surface 136 for the comfort of the user. To facilitate removal of the seat and back construction 10 from chair frame 12 as previously described, back rest member 134 is pivotal about hinge edge 138 to move the back rest adjacent seat member 76 as shown in dotted line in FIG. 8.

During use of seat and back construction 10 by a person seated in the chair, seat member 76 and connected back rest member 134 normally is orientated in the position shown in FIGS. 1 and 2 with back rest member 134 resting against and supported by cylindrical brace member 70 positioned between extensions 62, 64 of chair base 48. When it is desired for the user to move his or her body into a reclining position on the chair, such action can be accomplished by movement of seat member 76 in its horizontally disposed plane toward the front of the chair in the manner described below. As shown in solid line in FIG. 8, such movement of seat member 76 simultaneously will move hingedly connected back rest member 134 to a new angular position with respect to normal to permit reclining of the person seated in the chair.

Seat member 76 is movable along its horizontal plane through several selected positions such that back rest member 134 supported by cylindrical brace member 70 also is movable into several selected angular dispositions for various reclining positions of the user. Movement of seat member 76 as shown in FIG. 8 to permit reclining disposition of the wheelchair user causes the center of gravity 144 to change so that the same remains at a location with respect to the chair frame which will prevent instability of the same to the possible injury of the user. Thus, when seat member 76 is in its fully retracted position shown in dotted line in FIG. 8, the center of gravity 144 is located toward the rear of the chair. When seat member 76 is moved toward the front of the chair as shown in solid line in FIG. 8, with the resultant movement of back rest member 134 into a position to permit reclining orientation of the user, the center of gravity 144 is moved toward the front of the chair for increased stability when the user is in such reclining position.

Movement of seat member 76 along its horizontal plane as shown in FIG. 8 is accomplished by sliding movement of seat mounting tracks 82, 84 along their respective track guides 86, 88. Seat mounting tracks 82, 84 with seat member 76 attached are prevented from inadvertent movement along track guides 86, 88 by operation of seat latch member 146. As seen in FIGS. 4 and 5, seat latch member 146 includes latch plate 148 with locking flange 150 having teeth 152 adapted for mating engagement with teeth 154 formed on track guide 86. Latch plate 148 normally is maintained in locked condition with teeth 152 engaged against teeth 154 by latch plate spring 156 (FIG. 5) which draws the locking flange 150 into said locked position. In said locked position, seat mounting tracks 82, 84 with seat member 76 attached are immovable relative to track guides 86, 88. When it is desired to move seat member 76 toward the front of the chair to effect reclining orientation of the user, seat latch member 146 is operable to disengage teeth 152, 154 which permits movement of seat mounting tracks 82, 84 relative to track guides 86, 88. Release of seat latch member 146 is accomplished by operating of release lever 158 to pivot latch plate 148 about pivot pin 160 effecting disengagement of teeth 152, 154. Seat latch member then is permitted to return to its engagement position at a different location for seat member 76.

As a safety feature, release lever 158 is alternatively movable between two positions so as to prevent the user of the chair from having accessibility to the release lever to release seat latch member 146. Release lever 158 is sliadably movable between said two positions within sleeve 162 formed on latch plate 148. Release lever 158 is movable between a first position in which one end 164 is disposed proximate to the front of the chair accessible by the user (shown in FIG. 2), to a second position in which said one end 164 is withdrawn from accessibility by the user at the front end of the chair. In said second position, the end 166 opposite and 164 of lever 158 is accessible from the rear of the chair (as shown in FIG. 1). Release lever 158 is movable within sleeve 162 between said two positions and is prevented from being removed from said sleeve by respective front and rear stop abutments 168, 170 formed on release lever 158. Stop abutments 168, 170 engage against the opposite edge surfaces of sleeve 162 at the respective stop positions. Thus, when desired, release lever 158 can be moved into a position in which end 164 is not accessible by the user thereof from the front of the wheelchair to prevent the user's movement of the seat and back construction 10 into a reclining position. In this latter position, the construction 10 is movable into reclining position from the rear of the chair only. This is an additional safety feature to prevent possible injury to the user of the chair if it is determined that he or she should not independently be permitted to move the same into reclining position.

As an additional safety feature, a security belt 172 is retained upon the chair for fastening around the user's waist. Guides 174, 176 are affixed to opposite sides of back rest member 134 to maintain security belt 172 in its intended position on the chair.

Although the seat and back construction 10 of the invention is illustrated using coil springs 74 for facilitating rocking movement of chair base 48 with respect to chair support 20, it is contemplated that other forms of resilient members may be used within the intended scope of the invention. For instance, leaf springs or U springs may be substituted for coil springs 74. Other variations in the structure and the arrangement and size of the various parts may occur to those skilled in the art without departing from the spirit or circumventing the scope of the invention as set forth in the appended claims.

We claim:

1. A wheelchair seat comprising, a chair support adapted to be removably positioned on a frame part of a wheelchair, a chair base mounted on said chair support and having a seat platform secured thereto, spring means positioned between said base and support for imparting rocking movement to said chair base relative to said chair support, and locking means between said chair base and chair support operable to selectively render said chair base immovable relative to said chair support.

2. A wheelchair seat as claimed in claim 1 in which said chair support and chair base have respective flange extensions cojoined about a pivot pin passing through said extensions.

3. A wheelchair seat as claimed in claim 1 in which said chair support is of generally rectangular dish-shaped configuration with parallel side walls and parallel front and rear walls and a base surface between said walls.

4. A wheelchair seat as claimed in claim 3 in which said side walls include respective mounting brackets extending therefrom for removably positioning the seat upon the frame of a wheelchair.

5. A wheelchair seat as claimed in claim 4 including pin means for cooperation with said mounting brackets to removably secure said seat to the frame.

6. A wheelchair seat as claimed in claim 3 in which said chair support includes a pair of flange extensions upstanding from said base surface proximate the central area thereof.

7. A wheelchair seat as claimed in claim 6 in which said chair base includes a pair of generally L-shaped flanges with a respective horizontally disposed leg and a vertically disposed leg, said vertically disposed legs being positioned proximate the flange extensions upstanding from said base surface of the chair support.

8. A wheelchair seat as claimed in claim 7 including a pivot pin passing through said vertically disposed legs and said flange extensions upstanding from said base surface.

9. A wheelchair seat as claimed in claim 8 in which said spring means include four coil springs positioned proximate the corners of the chair support between the base surface and the horizontally disposed legs of the chair base.

10. A wheelchair seat as claimed in claim 1 including a back rest member hingedly connected to said seat platform, said back rest member being pivotal about the hinge connection with the seat platform to move the back rest member adjacent the seat platform.

11. A wheelchair seat as claimed in claim 10 in which said seat platform is positioned upon respective seat mounting tracks which are movable along corresponding track guides secured to said chair base, said back rest member being supported along its surface removed from the hinge connection with the seat platform by a brace member extending from said chair base.

12. A wheelchair seat as claimed in claim 11 in which said back rest member is movable between variable angular dispositions with respect to normal upon movement of said seat platform along said track guides.

13. A wheelchair seat as claimed in claim 12 including a seat latch member operable between one of said mounting tracks and its corresponding track guide to selectively prevent movement of said seat platform.

14. A wheelchair seat comprising, a chair support, a chair base mounted on said chair support and having a seat platform secured thereto, spring means positioned between said base and support for imparting rocking movement to said chair base relative to said chair support, and locking means between said chair base and chair support operable to selectively render said chair base immovable relative to said chair support, said locking means including a first locking lever accessible to the user of the seat only from one side thereof, and a second locking lever accessible only from a side of the seat opposite to said one side and inaccessible to the user of the seat from said one side, said locking levers being movable between a locking position and unlocking position, said chair base being movable relative to said chair support only upon movement of both locking levers into their respective unlocking positions.

15. A wheelchair seat as claimed in claim 14 in which said chair support and said chair base have respective flange extensions cojoined about a pivot pin passing through said extensions, said chair support being of generally rectangular dish-shaped configuration with parallel side walls and parallel front and rear walls, and a base surface between said walls, said first locking lever being of generally elongate bar-shaped configuration pivotally mounted upon said pivot pin between said extensions, said first locking lever being pivotal into a locking position in which one end thereof is disposed to abut said base surface and the other end thereof is engaged against the free edge of said front wall, said first locking lever having a pin extending from a side thereof, a flange extension of said chair base having an aperture provided therein, said pin being disposed within said aperture when the first locking lever is in its locking position.

16. A wheelchair seat as claimed in claim 15 including a locking lever spring secured between said first locking lever and said base surface to maintain said pin within said aperture.

17. A wheelchair seat as claimed in claim 15 in which said first locking lever is pivotal into an unlocking position in which said one end is separated from said base surface, the front wall having a slot formed therein and said first locking lever being positioned within said slot when the lever is pivoted into said unlocking position.

18. A wheelchair seat as claimed in claim 15 in which said second locking lever is of generally elongate bar-shaped configuration pivotally mounted upon said pivot pin between said extensions, said second locking lever being pivotal into a locking position in which one end thereof is disposed to abut said base surface and the other end thereof is engaged against the free edge of said rear wall, said second locking lever having a pin extending from a side thereof, a flange extension of said chair base having an aperture provided therein, said pin being disposed within said aperture when the second locking lever is in its locking position.

19. A wheelchair seat as claimed in claim 18 including a locking lever spring secured between said second locking lever and said base surface to maintain said pin within said aperture.

20. A wheelchair seat as claimed in claim 18 in which said second locking lever is pivotal into an unlocking position in which said one end is separated from said base surface, the rear wall having a slot formed therein and said second locking lever being positioned within said slot when the lever is pivoted into said unlocking position.

21. A wheelchair seat comprising, a chair support, a chair base mounted on said chair support and having a seat platform secured thereto, spring means positioned between said base and support for imparting rocking movement to said chair base relative to said chair support, locking means between said chair base and chair support operable to selectively render said chair base immovable relative to said chair support, a back rest member hingedly connected to said platform, said back rest member being pivotal about the hinge connection with the seat platform to move the back rest member adjacent the seat platform, said seat platform being positioned upon respective seat mounting tracks which are movable along corresponding track guides secured to said chair base, said back rest member being supported along its surface removed from the hinge connection with the seat platform by a brace member extending from said chair base, said back rest member being movable between variable angular dispositions with respect to normal upon movement of said seat platform along said track guides, a seat latch member operable between one of said mounting tracks and its corresponding track guide to selectively prevent movement of said seat platform, said seat latch member including a release lever to unlatch the seat platform for movement thereof, said release lever being movable in said seat latch member from a first position in which the lever is accessible to the user of the seat only from one side thereof, and a second position in which the lever is inaccessible to the user of the seat from said one side.

22. A wheelchair seat as claimed in claim 21 in which said seat latch member includes a sleeve and said release lever is retained within said sleeve, said lever having respective front and rear stop abutments formed thereon to engage against opposite ends of the sleeve when the lever is in its respective positions.

23. A wheelchair comprising, a frame, a chair support adapted to be removably positioned on said frame, a chair base mounted on said chair support and having a seat platform secured thereto, spring means positioned between said base and support for imparting rocking movement to said chair base relative to said chair support, and locking means between said chair base and chair support operable to selectively render said chair base immovable relative to said chair support.

24. A wheelchair as claimed in claim 23 in which said chair support and chair base have respective flange extensions cojoined about a pivot pin passing through said extensions.

25. A wheelchair as claimed in claim 23 in which said chair support is of generally rectangular dish-shaped configuration with parallel side walls and parallel front and rear walls, and a base surface between said walls.

26. A wheelchair as claimed in claim 25 in which said side walls include respective mounting brackets extending therefrom for removably positioning the seat upon the frame.

27. A wheelchair as claimed in claim 26 including pin means for cooperation with said mounting brackets to removably secure said seat to the frame.

28. A wheelchair as claimed in claim 25 in which said chair support includes a pair of flange extensions upstanding from said base surface proximate the central area thereof.

29. A wheelchair as claimed in claim 28 in which said chair base includes a pair of generally L-shaped flanges with a respective horizontally disposed leg and a vertically disposed leg, said vertically disposed legs being positioned proximate the flange extensions upstanding from said base surface of the chair support.

30. A wheelchair as claimed in claim 29 including a pivot pin passing through said vertically disposed legs and said flange extensions upstanding from said base surface.

31. A wheelchair as claimed in claim 30 in which said spring means include four coil springs positioned proximate the corners of the chair support between the base surface and the horizontally disposed legs of the chair base.

32. A wheelchair as claimed in claim 23 including a back rest member hingedly connected to said seat platform, said back rest member being pivotal about the hinge connection with the seat platform to move the back rest member adjacent the seat platform.

33. A wheelchair as claimed in claim 32 in which said seat platform is positioned upon respective seat mounting tracks which are movable along corresponding track guides secured to said chair base, said back rest member being supported along its surface removed from the hinge connection with the seat platform by a brace member extending from said chair base.

34. A wheelchair as claimed in claim 33 in which said back rest member is movable between variable angular dispositions with respect to normal upon movement of said seat platform along said track guides.

35. A wheelchair as claimed in claim 34 including a seat latch member operable between one of said mounting tracks and its corresponding track guide to selectively prevent movement of said seat platform.

36. A wheelchair comprising, a frame, a chair support adapted to be secured to said frame, a chair base mounted on said chair support and having a seat platform secured thereto, spring means positioned between said base and support for imparting rocking movement to said chair base relative to said chair support, and locking means between said chair base and chair support operable to selectively render said chair base immovable relative to said chair support, said locking means including a first locking lever accessible to the user of the seat only from one side thereof, and a second locking lever accessible only from a side of the seat opposite to said one side and inaccessible to the user of the seat from said one side, said locking levers being movable between a locking position and an unlocking position, said chair base being movable relative to said chair support only upon movement of both locking levers into their respective unlocking positions.

37. A wheelchair as claimed in claim 36 in which said chair support and said chair base have respective flange extensions cojoined about a pivot pin passing through said extensions, said chair support being of generally rectangular dish-shaped configuration with parallel side walls and parallel front and rear walls, and a base surface between said walls, said first locking lever being of generally elongate bar-shaped configuration pivotally mounted upon said pivot pin between said extensions, said first locking lever being pivotal into a locking position in which one end thereof is disposed to abut said base surface and the other end thereof is engaged against the free edge of said front wall, said first locking lever having a pin extending from a side thereof, a flange extension of said chair base having an aperture provided therein, said pin being disposed within said aperture when the first locking lever is in its locking position.

38. A wheelchair as claimed in claim 37 including a locking lever spring secured between said first locking lever and said base surface to maintain said pin within said aperture.

39. A wheelchair as claimed in claim 37 which said first locking lever is pivotal into an unlocking position in which said one end is separated from said base surface, the front wall having a slot formed therein and said first locking lever being positioned within said slot when the lever is pivoted into said unlocking position.

40. A wheelchair as claimed in claim 37 in which said second locking lever is of generally elongate bar-shaped configuration pivotally mounted upon said pivot pin between said extensions, said second locking lever being pivotal into a locking position in which one end thereof is disposed to abut said base surface and the other end thereof is engaged against the free edge of said rear wall, said second locking lever having a pin extending from a side thereof, a flange extension of said chair base having an aperture provided therein, said pin being disposed within said aperture when the second locking lever is in its locking position.

41. A wheelchair as claimed in claim 40 including a locking lever spring secured between said second locking lever and said base surface to maintain said pin within said aperture.

42. A wheelchair as claimed in claim 40 in which said second locking lever is pivotal into an unlocking position in which said one end is separated from said base surface, the rear wall having a slot formed therein and said second locking lever being positioned within said slot when the lever is pivoted into said unlocking position.

43. A wheelchair comprising, a frame, a chair support adapted to be secured to said frame, a chair base mounted on said chair support and having a seat platform secured thereto, spring means positioned between said base and support for imparting rocking movement to said chair base relative to said chair support, locking means between said chair base and chair support operable to selectively render said chair base immovable relative to said chair support, a back rest member hingedly connected to said seat platform, said back rest member being pivotal about the hinge connection with the seat platform to move the back rest member adjacent the seat platform, said seat platform being positioned upon respective seat mounting tracks which are movable along corresponding track guides secured to said chair base, said back rest member being supported along its surface removed from the hinge connection with the seat platform by a brace member extending from said chair base, said back rest member being movable between variable angular dispositions with respect to normal upon movement of said seat platform along said track guides, a seat latch member operable between one of said mounting tracks and its corresponding track guide to selectively prevent movement of said seat platform, said seat latch member including a release lever to unlatch the seat platform for movement thereof, said release lever being movable in said seat latch member from a first position in which the lever is accessible to the user of the seat only from one side thereof, and a second position in which the lever is inaccessible to the user of the seat from said one side.

44. A wheelchair as claimed in claim 43 in which said seat latch member includes a sleeve and said release lever is retained within said sleeve, said lever having respective front and rear stop abutments formed thereon to engage against opposite ends of the sleeve when the lever is in its respective positions.

* * * * *